US007910070B2

(12) United States Patent
Zimmerman et al.

(10) Patent No.: US 7,910,070 B2
(45) **Date of Patent: *Mar. 22, 2011**

(54) PROCESS FOR REDUCING BENZENE CONCENTRATION IN REFORMATE

(75) Inventors: Cynthia K. Zimmerman, Palatine, IL (US); Gavin P. Towler, Inverness, IL (US)

(73) Assignee: UOP LLC, Des Plaines, IL (US)

( * ) Notice: Subject to any disclaimer, the term of this patent is extended or adjusted under 35 U.S.C. 154(b) by 247 days.

This patent is subject to a terminal disclaimer.

(21) Appl. No.: 12/331,048

(22) Filed: Dec. 9, 2008

(65) Prior Publication Data

US 2010/0143213 A1 Jun. 10, 2010

(51) Int. Cl.

| | |
|---|---|
| ***B01J 19/00*** | (2006.01) |
| *B01J 8/00* | (2006.01) |
| *B01J 10/00* | (2006.01) |
| *C07C 7/00* | (2006.01) |
| *C10G 35/00* | (2006.01) |
| *C10G 45/00* | (2006.01) |

(52) U.S. Cl. ..... 422/187; 585/258; 208/133; 208/142

(58) Field of Classification Search ..... 422/187; 585/258; 208/133, 142

See application file for complete search history.

(56) References Cited

U.S. PATENT DOCUMENTS

| | | | |
|---|---|---|---|
| 4,741,820 | A | 5/1988 | Coughlin et al. |
| 5,817,227 | A | 10/1998 | Mikitenko et al. |
| 5,905,182 | A | 5/1999 | Streicher et al. |
| 5,914,435 | A | 6/1999 | Streicher et al. |
| 6,048,450 | A | 4/2000 | Mikitenko et al. |
| 6,174,428 | B1 | 1/2001 | Ambrosino et al. |
| 6,238,549 | B1 | 5/2001 | Viltard et al. |
| 6,261,442 | B1 | 7/2001 | Ambrosino et al. |
| 2010/0016645 | A1* | 1/2010 | Cosyns et al. ..... 585/258 |

FOREIGN PATENT DOCUMENTS

| | | |
|---|---|---|
| DE | 243926 | 3/1987 |
| KR | 2004089354 | 4/2003 |
| KR | 2004024776 | 3/2004 |

OTHER PUBLICATIONS

RD 411049 A, Jul. 10, 1988, Anonymous.
JP 299-0107, 2003, Yoshiro Takaya.
RU 660:51.001.57+66, 2002, Timoshenko et al.

(Continued)

*Primary Examiner* — Walter D Griffin
*Assistant Examiner* — Natasha Young
(74) *Attorney, Agent, or Firm* — Maryann Maas

(57) ABSTRACT

A process and system for separating and saturating benzene from a reforming reactor effluent begins with introducing the reforming reactor effluent to a combined stabilizer and naphtha splitter. An overhead stream comprising light ends, a sidecut stream comprising C4– C5 compounds, a bottoms stream comprising C7+ compounds and a heart cut stream comprising C4, C5, C6 compounds including benzene are all removed from the combined stabilizer and naphtha splitter. The heart cut stream is introduced to a side stripper to produce a side stripper overhead stream reduced in benzene and a side stripper bottoms stream enriched in benzene. At least a portion of the side stripper bottoms stream enriched in benzene is introduced into a hydrogenation zone to saturate benzene and generate a hydrogenation zone effluent reduced in benzene. The side stripper overhead stream may be recycled to the combined stabilizer and naphtha splitter.

10 Claims, 1 Drawing Sheet

OTHER PUBLICATIONS

U.S. Appl. No. 12/331,048, filed Dec. 9, 2008, Zimmerman et al.
Grzechowiak et al., "Gasoline with reduced benzene content—process changes", Inst. Chemical I Technol. Nefty I Wegla, Przemysl Chemiczny (2000), 47-50, Wroclaw, Poland.
Singliar et al., "Decrease of the energy requirement of reformate redistillation", Odbor Technol. Slovnaft S.P. Bratislava 824 17, Ropa a Uhlie 1991, 33(1-2) 35-9, Slovak.
Maikov, V.O., "Synthesis of the optimum structure of ractional distillation systems" Inst. Teoreticheskie Osnovy Khimicheskoi Teknologii (1974) 435-41, Moscow, USSR.
Cosyns, J. et al., "The Future Role of Aromatics in Refining and Petrochemistry", DGMK Tagungsbericht (1999) 65-72, France.
Muzayyin et al., International Jour. of Energy Systems, vol. 8, No. 3, 1988, 8(3) 138-43, California State University, Long Beach, CA.
Alatiqi et al., "Control of a Complex Sidestream Column/Stripper Distillation Configuration", 1986 Amer. Chem. Soc., 762-767, Bethlehem, PA.
Doukas et al., Control of an Energy-Conserving Prefractionator/Sidestream Column Distillation System:, 1980 Amer. Chem. Soc., 147-153, Bethlehem, PA.
Ishikawa et al., "Calculations of Multicomponent Distillation Column with Multi-Feeds and Side-Streams", Bulletin Japanese Petroleum Inst. 18-26, Tokyo, Japan, (May 1972).
Miramanyan, Petroleum Refining and the Petroleum Chemistry #8 2006 11-14_MT_ENG.

* cited by examiner

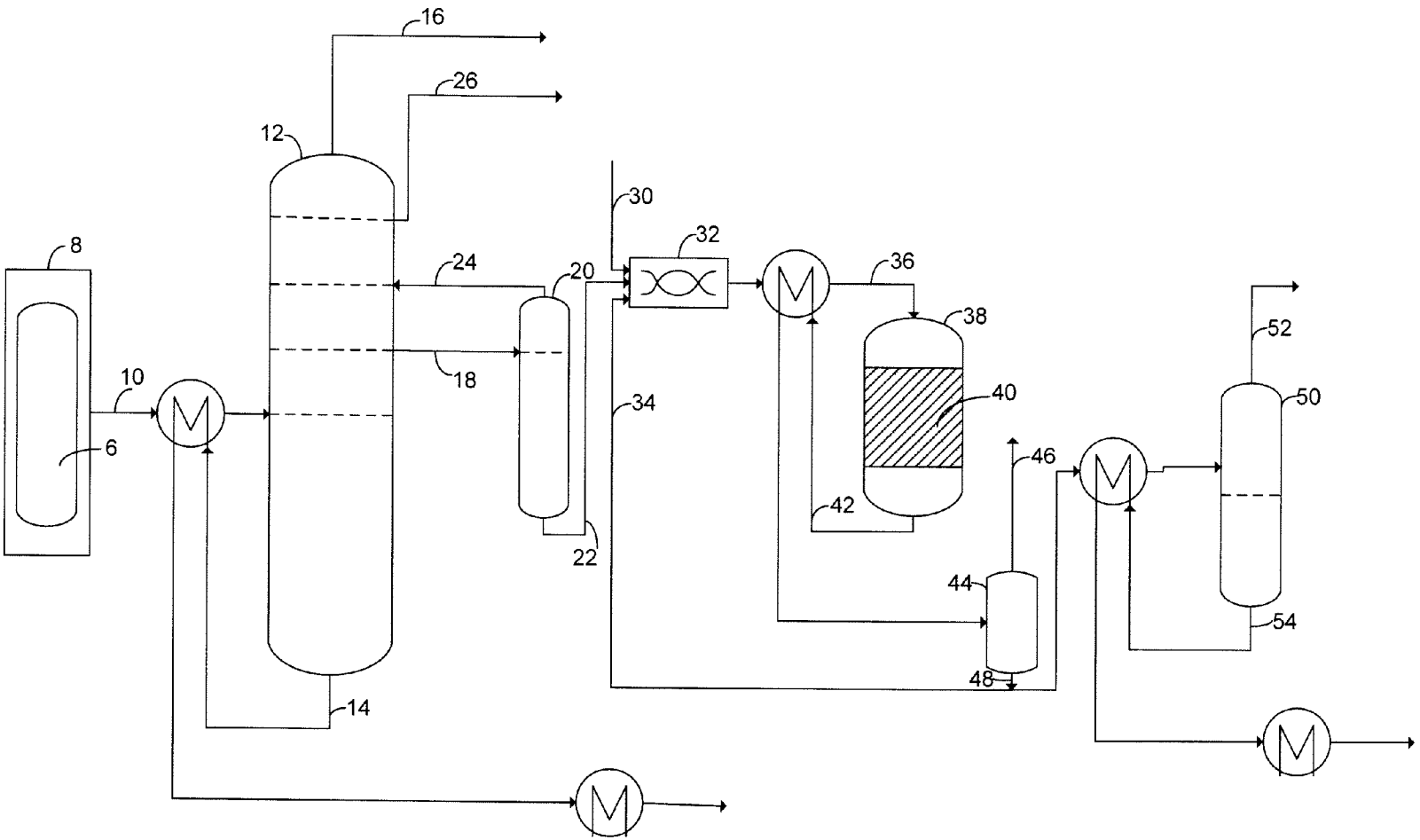
FIGURE

PROCESS FOR REDUCING BENZENE CONCENTRATION IN REFORMATE

FIELD OF THE INVENTION

A process for reducing benzene concentration in reformate by separating the reformate in a combined stabilizer naphtha splitter to remove benzene in a heart cut stream, concentrating the benzene from the heart cut stream in a side stripper bottoms stream, and saturating the benzene in the side stripper bottoms stream.

BACKGROUND OF THE INVENTION

High octane gasoline is required for modern gasoline engines. Formerly it was common to accomplish octane number improvement by the use of various lead-containing additives. When lead was phased out of gasoline for environmental reasons, became necessary to rearrange the structure of the hydrocarbons used in gasoline blending in order achieve higher octane ratings. Catalytic reforming is a widely used process for this refining of crude oil to increase the yield of higher octane gasoline which sells at higher prices. The traditional gasoline blending pool normally includes $C_4$ and heavier hydrocarbons having boiling points of less than 205° C. (395° F.) at atmospheric pressure. In catalytic reforming, the paraffins and naphthenes are passed through the reformer with the goal of minimizing cracking. Instead their structure is rearranged to form higher octane aromatics. Essentially catalytic reforming converts low octane paraffins to naphthenes. Naphthenes are converted to higher octane aromatics. Aromatics are left essentially unchanged.

The chemical reactions involved in a reforming process are very complex. The reactions are commonly grouped into four categories: cracking, dehydrocyclization, dehydrogenation, and isomerization. A particular hydrocarbon/naphtha feed molecule may undergo more than one category of reaction and/or may form more than one product.

Catalytic reforming processes are catalyzed by either mono-functional or bi-functional reforming catalysts. A mono-functional metallic catalyst usually has only one (precious) metal catalytic site for catalyzing the reforming reactions. Also known are bimetallic functional catalyst in which two different precious metals exist to provide two metallic catalytic sites. A bi-functional catalyst has both metal sites and acidic sites. Refineries generally use a platinum catalyst or platinum alloy supported on a silica or silica-aluminum substrate as the reforming catalyst, although other catalysts, including the oxides of aluminum, chromium, molybdenum, cobalt, and silicon can be used.

The selection and/or design of a particular reforming catalyst primarily depends on the hydrocarbon/naphtha feed composition, the impurities present therein, and the desired products. A catalyst can be designed, or may be selected, to favor one or more of the four categories of chemical reactions, and thereby may influence both the yield of and selectivity of conversion of paraffinic and naphthenic hydrocarbon precursors to particular aromatic hydrocarbon structures. Efforts continue to advancing reforming technology, especially with the ever-changing demands for gasoline.

Currently, refiners are limiting the quantity of benzene that is blended into the gasoline pool. Benzene is one of the products of the reforming process. Described herein is a process for efficiently removing the benzene from the reforming reactor effluent, concentrating the benzene, and saturating the benzene.

SUMMARY OF THE INVENTION

A system for separating and saturating benzene from a reforming reactor effluent has been invented. The system comprises a combined stabilizer and naphtha splitter; a side stripper; a hydrogenation reactor; and a reformate conduit in fluid communication with the combined stabilizer and naphtha splitter. The units are interconnected using an overhead conduit in fluid communication with the combined stabilizer and naphtha splitter; a sidecut conduit in fluid communication with the combined stabilizer and naphtha splitter; a bottoms conduit in fluid communication with the combined stabilizer and naphtha splitter; a heart cut conduit in fluid communication with the combined stabilizer and naphtha splitter and with the side stripper; a side stripper overhead conduit in fluid communication with the side stripper and with the combined stabilizer and naphtha splitter; a side stripper bottoms conduit in fluid communication with the side stripper and with the hydrogenation reactor; and a hydrogenation reactor effluent conduit in fluid communication with the hydrogenation reactor.

Optionally, the system may have a heat exchanger incorporating the reformate conduit and the bottoms conduit and or a heat exchanger incorporating the side stripper bottoms conduit and the hydrogenation reactor effluent conduit. the system may further comprise a separator in fluid communication with the hydrogenation reactor effluent conduit, a separator overhead conduit in fluid communication with the separator; and a separator bottoms conduit in fluid communication with the separator and with a stabilizer; a stabilizer overhead conduit in fluid communication with the stabilizer; and a stabilizer bottoms conduit in fluid communication with the stabilizer. A heat exchanger incorporating the separator bottoms conduit and the stabilizer bottoms conduit may be present. The system may optionally have a hydrogen conduit in fluid communication with the side stripper bottoms conduit. the side stripper bottoms conduit may comprise a mixing device. The system may have a recycle conduit in fluid communication with the separator bottoms conduit and the side stripper bottoms conduit. The side cut conduit may be in fluid communication with the combined stabilizer and naphtha splitter at a location between the overhead conduit and the side stripper overhead conduit. The heart cut conduit may be in fluid communication with the combined stabilizer and naphtha splitter at a location between the reformate conduit and the side stripper overhead conduit.

BRIEF DESCRIPTION OF THE FIGURE

The FIGURE is a schematic depiction of an exemplary embodiment of the invention.

DETAILED DESCRIPTION OF THE INVENTION

This invention relates to removing benzene from the effluent of a reforming operation. The process for removing the benzene comprises introducing the effluent to a combined stabilizer-naphtha splitter to separate a heart cut stream comprising at least benzene, passing the heart cut stream to a side stripper to concentrate and remove the benzene while returning a stream comprising valuable hydrocarbons but reduced in benzene to the combined stabilizer-naphtha splitter. The bottoms stream from the side stripper, which is enriched in benzene as compared to the heart cut stream, may be introduced into a hydrogenation system for benzene saturation.

With respect to the reforming zone which generates the reforming zone effluent, a wide variety of reforming zone feed stocks may be used. In general, the reforming zone feed stock contains from $C_6$ to about $C_{11}$ or $C_{12}$ hydrocarbons with a boiling point range from about 82 to about 240° C. Specific reforming zone feedstocks may be generated using separation techniques. For example, a naphtha feedstock may be introduced into a separation zone comprising one or more fractional distillation columns to separate a heart-cut naphtha fraction from a heavy naphtha fraction. The lower-boiling heart-cut naphtha may contain a substantial concentration of $C_7$ and $C_8$ hydrocarbons, which can be catalytically reformed to produce a reformate component suitable for blending into current reformulated gasoline. This heart-cut naphtha also may contain significant concentrations of $C_6$ and $C_9$ hydrocarbons, plus smaller amounts of lower- and higher-boiling hydrocarbons, depending on the applicable gasoline specifications and product needs. The heart-cut naphtha end point may range from about 130° to 175° C., and preferably is within the range of about 145° to 165° C. The higher-boiling heavy naphtha may contain a substantial amount of $C_{10}$ hydrocarbons, and also may contain significant quantities of lighter and heavier hydrocarbons depending primarily on a petroleum refiner's overall product balance. The initial boiling point of the heavy naphtha is between about 120° and 175° C., and preferably is between 140° and 165° C.

A light naphtha fraction may also be separated from the naphtha feedstock in a separation zone. The light naphtha comprises pentanes, and may comprise $C_6$ and possibly a limited amount of $C_7$ hydrocarbons. This fraction may be separated from the heart-cut naphtha because pentanes are not converted efficiently in a reforming zone, and optionally because $C_6$ hydrocarbons may be an undesirable feed to catalytic reforming where they are converted to benzene for which gasoline restrictions are being implemented. The light naphtha fraction may be separated from the naphtha feedstock before it enters the separation zone, in which case the separation zone would only separate heart-cut naphtha from heavy naphtha. If the pentane content of the naphtha feedstock is substantial, however, separation of light naphtha generally is desirable. This alternative separation zone generally comprises two fractionation columns, although in some cases a single column recovering light naphtha overhead, heavy naphtha from the bottom and heart-cut naphtha as a side stream could be suitable.

For purposes of discussion, the reforming zone feedstock will contain from $C_6$ to about $C_{12}$ hydrocarbons with a boiling point range from about 82 to about 204° C. The reforming zone feedstock is introduced to a heat exchanger to exchange heat with the reforming zone effluent stream. The heated reforming zone feed stream is then conducted to the reforming zone. The reforming zone upgrades the octane number of the reforming feed stream through a variety of reactions including naphthene dehydrogenation and paraffin dehydrocyclization and isomerization. The product reformate, which may contain a small amount of isomerate, may be used for gasoline blending to form motor fuel or may be further processed.

Reforming operating conditions used may include a pressure of from about atmospheric to about 6080 kPa(a), with the preferred range being from atmospheric to about 2026 kPa(a) and a pressure of below 1013 kpa(a) being especially preferred. Hydrogen is generated within the reforming zone, but additional hydrogen may be directed, if necessary, to the reforming zone in an amount sufficient to correspond to a ratio of from about 0.1 to 10 moles of hydrogen, but generated and added, per mole of hydrocarbon feedstock. The volume of the contained reforming catalyst corresponds to a liquid hourly space velocity of from about 1 to 40 $hr^{-1}$. The operating temperature generally is in the range of 260° to 560° C.

Reforming catalysts may comprise a supported platinum-group metal component which comprises one or more platinum-group metals, with a platinum component being preferred. An illustrative platinum component generally comprises from about 0.01 to 2 mass % of the catalytic composite, preferably 0.05 to 1 mass %, calculated on an elemental basis. Reforming catalysts may contain other metal components known to modify the effect of the preferred platinum component. Such metal modifiers may include Group IVA (14) metals, other Group VIII (8-10) metals, rhenium, indium, gallium, zinc, uranium, dysprosium, thallium and mixtures thereof. A preferred metal modifier is a tin component. Catalytically effective amounts of such metal modifiers may be incorporated into the catalyst by any means known in the art.

The reforming catalyst may be a dual-function composite containing a metallic hydrogenation-dehydrogenation component on a refractory support which provides acid sites for cracking and isomerization. The refractory support of the reforming catalyst should be a porous, adsorptive, high-surface-area material which is uniform in composition without composition gradients of the species inherent to its composition. Examples of suitable refractory supports are those containing one or more of: (1) refractory inorganic oxides such as alumina, silica, titania, magnesia, zirconia, chromia, thoria, boria or mixtures thereof; (2) synthetically prepared or naturally occurring clays and silicates, which may be acid-treated; (3) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations; (4) non-zeolitic molecular sieves as disclosed in U.S. Pat. No. 4,741,820, incorporated by reference; (5) spinels such as $MgAl_2O_4$, $FeAl_2O_4$, $ZnAl_2O_4$, $CaAl_2O_4$; and (6) combinations of materials from one or more of these groups.

A preferred refractory support for reforming catalysts is alumina, with gamma- or eta-alumina being particularly preferred. The alumina powder may be formed into any shape or form of carrier material known to those skilled in the art such as spheres, extrudates, rods, pills, pellets, tablets or granules. Preferred spherical particles may be formed by converting the alumina powder into alumina sol by reaction with suitable peptizing acid and water and dropping a mixture of the resulting sol and gelling agent into an oil bath to form spherical particles of an alumina gel, followed by known aging, drying and calcination steps. The alternative extrudate form is preferably prepared by mixing the alumina powder with water and suitable peptizing agents, such as nitric acid, acetic acid, aluminum nitrate and like materials, to form an extrudable dough having a loss on ignition (LOI) at 500° C. of about 45 to 65 mass %. The resulting dough is extruded through a suitably shaped and sized die to form extrudate particles, which are dried and calcined by known methods. Alternatively, spherical particles can be formed from the extrudates by rolling the extrudate particles on a spinning disk.

Reforming catalysts may optimally contain a halogen component. The halogen component may be either fluorine, chlorine, bromine or iodine or mixtures thereof. Chlorine is the preferred halogen component.

The reforming catalyst may comprise a large-pore molecular sieve such as a molecular sieve having an effective pore diameter of about 7 angstroms or larger. Examples of large-pore molecular sieves which might be incorporated into the present catalyst include LTL, FAU, AFI and MAZ (IUPAC Commission on Zeolite Nomenclature) and zeolite-beta. Or, the reforming catalyst may contain a nonacidic L-zeolite (LTL) and an alkali-metal component as well as a platinum-group metal component. It is often necessary to composite the L-zeolite with a binder in order to provide a convenient form. Any refractory inorganic oxide binder is suitable. One or more of silica, alumina or magnesia may be preferred binder materials. The L-zeolite and binder may be composited to form the desired catalyst shape by any method known in the art. An alkali metal component is part of the alternative reforming catalyst. One or more of the alkali metals, including lithium, sodium, potassium, rubidium, cesium and mixtures thereof, may be used, with potassium being preferred. The alkali metal optimally will occupy essentially all of the cationic exchangeable sites of the nonacidic L-zeolite.

The final reforming catalyst generally is dried at a temperature of from about 100° to 320° C. for about 0.5 to 24 hours, followed by oxidation at a temperature of about 300° to 550° C. in an air atmosphere for 0.5 to 10 hours. The oxidized catalyst may be subjected to a substantially water-free reduction step at a temperature of about 300° to 550° C. (preferably about 350° C.) for 0.5 to 10 hours or more. The duration of the reduction step should be only as long as necessary to reduce the platinum, in order to avoid pre-deactivation of the catalyst, and may be performed in-situ as part of the plant startup if a dry atmosphere is maintained.

The reforming zone feed stream may contact the reforming catalyst in either upflow, downflow, or radial-flow mode. The catalyst is contained in a fixed-bed reactor or in a moving-bed reactor whereby catalyst may be continuously withdrawn and added. These alternatives are associated with catalyst-regeneration options known to those of ordinary skill in the art, such as: (1) a semi-continuous regenerative unit containing fixed-bed reactors maintains operating severity by increasing temperature, eventually shutting the unit down for catalyst regeneration and reactivation; (2) a swing-reactor unit, in which individual fixed-bed reactors are serially isolated by manifolding arrangements as the catalyst become deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst, permitting higher operating severity by maintaining high catalyst activity through regeneration cycles of a few days; or (4) a hybrid system with semi-continuous regenerative and continuous-regeneration provisions in the same unit. One embodiment of the reforming process is a moving-bed reactor with continuous catalyst regeneration which can realize high yields of desired $C_5$+ product at relatively low operating pressures associated with more rapid catalyst deactivation. The total product stream from the reforming zone generally is conducted to the heat exchanger to exchange heat with the reforming zone feedstock.

The $C_5$ and heavier hydrocarbons from the reformate separation zone are traditionally conducted to a reforming zone stabilizer where additional $C_4$ and lighter hydrocarbons and some hydrogen are removed in a reforming zone stabilizer overhead stream. Traditionally the bottom stream of the stabilizer may contain reformate suitable for gasoline blending to form motor fuel or further processing. For example, the bottom stream of the stabilizer may be sent to a naphtha splitter to separate C7+ hydrocarbons from C6− hydrocarbons. The resulting overhead of primarily C5 and C6 hydrocarbons may be blended into the gasoline pool and the C7+ hydrocarbons may be further processed.

However, in the process herein the effluent from the reforming zone or optionally, the unstabilized $C_5$ and heavier hydrocarbons from a product separation zone are sent to a combined stabilizer and naphtha splitter column. The combined column performs both of the separation functions of an individual naphtha stabilizer and a naphtha splitter. The combined stabilizer and naphtha splitter removes light ends such as gases and C4 minus compounds as well as separates the much of the heavier components, C7+ from the gasoline range components. The combined zone is operated at conditions including from about 38° C. to about 121° C. (about 100° F. to about 250° F.) temperature range, from about 70 kpa(g) to about 1379 kPa(g) (about 10 to about 200 psig) pressure range.

The reforming zone effluent is introduced at an intermediate location of the combined stabilizer and naphtha splitter. Distillation occurring in the combined stabilizer and naphtha splitter drives the lighter compounds upward in the column while the heavier components fall to the bottom of the column. A combined stabilizer and naphtha splitter bottoms stream comprising C7+ compounds is withdrawn from a location at or near the bottom of the combined stabilizer and naphtha splitter. A combined stabilizer and naphtha splitter overhead stream comprising gases and C4− compounds is withdrawn from a location at or near the top of the combined stabilizer and naphtha splitter.

Two additional streams are withdrawn from the combined stabilizer and naphtha splitter. A side cut stream and a heart cut stream are both removed from the combined stabilizer and naphtha splitter. The side cut stream is removed from a location between the heart cut stream and the overhead stream. The location is selected at a height of the column so that the side cut stream comprises the desired C5 and C6 compounds. The side cut stream contains the components most desired for blending into a gasoline pool. The heart cut stream is removed from a location between the side cut stream and the bottoms stream. The location is selected at a height of the column so that the heart cut stream comprises benzene, and in one embodiment the location of removal of the heart cut stream is at a point where the concentration of benzene in the heart cut stream is optimized or maximized.

The heart cut stream, in addition to comprising benzene, will comprise C5 and C6 components which are highly valuable and therefore desirable to be included in the side cut stream. It is the benzene in the heart cut stream that is to be separated and removed while returning as much of the valuable C5 and C6 components as possible to the combined stabilizer and naphtha splitter. The heart cut stream is introduced to a side stripper. The goal of the side stripper is to concentrate the benzene into a bottoms stream and provide a side stripper overhead stream of C5 and C6 components that is reduced in benzene. The side stripper overhead stream may be recycled to the combined stabilizer and naphtha splitter so that the C5 and C6 components, reduced in benzene, can be collected as product via the combined stabilizer and naphtha splitter side cut stream. As used herein the term "reduced in benzene" means the subject stream has a lower concentration of benzene as compared to a stream entering a unit, and the term "enriched in benzene" means the subject stream has a higher concentration of benzene as compared to a stream entering a unit. In one embodiment, the location of the introduction of the side stripper overhead stream into the combined stabilizer and naphtha splitter is between the heart cut stream and the side cut stream. The side stripper is operated at conditions ranging from about 25° C. to about 250° C. or from about 250° C. to about 325° C. temperature range and from about 345 to about 1034 kPa(g) (50 to about 150 psig) pressure range.

The side stripper bottoms stream has a greater concentration of benzene than the heart cut stream. The side stripper bottoms stream may have from about 30 to about 60 wt. % benzene or from about 40 to about 55 wt. % benzene or from about 45 to about 50 wt. % benzene. The balance of the stream is C5, C6 and possibly some C7+ compounds. The side stripper bottoms stream is conducted to a hydrogenation zone for benzene saturation. Various different hydrogenation zones suitable for benzene saturation exist and one will be exemplified here without intending to limit the broad scope of the invention.

In one embodiment, the side stripper bottoms stream is introduced, along with hydrogen and optionally a recycle stream to a mixing device. The hydrogen stream is combined with the side stripper bottoms stream in order to provide hydrogen for consumption in the hydrogenation reaction of the benzene saturation. The amount of hydrogen mixed with the side stripper bottoms stream varies widely. A relatively high hydrogen to hydrocarbon ratio is used to provide the hydrogen that is consumed in the hydrogenation reaction. Therefore, hydrogen will usually be mixed with the side stripper bottoms stream and any optional recycle stream in an amount sufficient to create a combined feed having a hydrogen to hydrocarbon ratio of from 0.1 to 2.0. Lower hydrogen to hydrocarbon ratios in the combined feed are preferred to simplify the system and equipment associated with the addition of hydrogen. At minimum, the hydrogen to hydrocarbon ratio must supply the stoichiometric requirements for the hydrogenation reaction. In some applications it may be preferable that an excess of hydrogen be provided with the combined feed. Excess hydrogen may provide good stability and conversion by compensating for variations in feedstream compositions that alter the stoichiometric hydrogen requirements and to prolong catalyst life by suppressing side reactions such as cracking and disproportionation. Side reactions left unchecked reduce conversion and lead to the formation of carbonaceous compounds, i.e., coke, that foul the catalyst.

It has been found to be advantageous to minimize the amount of hydrogen added to the feedstock. When the hydrogen to hydrocarbon ratio at the effluent of the isomerization zone exceeds 0.20, it is not economically desirable to operate the process without the recovery and recycle of hydrogen to supply a portion of the hydrogen requirements. Facilities for the recovery of hydrogen from the effluent of the hydrogenation reactor are needed to prevent the loss of product and feed components that can escape with the flashing of hydrogen from the hydrogenation zone effluent. These facilities add to the cost of the process and complicate the operation of the process.

The effluent of the mixing device is fed to a hydrogenation reactor containing a hydrogenation catalyst. The effluent of the mixing device may be heat exchanged with the effluent of the benzene saturation reactor in order to at least partially heat the effluent of the mixing device before entering the benzene saturation reactor. The hydrogenation zone is designed to saturate benzene at relatively mild conditions. The hydrogenation zone comprises a bed of catalyst for promoting the hydrogenation of benzene. Examples of catalyst compositions include platinum group, tin or cobalt and molybdenum metals on suitable refractory inorganic oxide supports such as alumina. In one embodiment, the alumina is an anhydrous gamma-alumina with a high degree of purity. The term platinum group metals refers to noble metals excluding silver and gold which are selected from the group consisting of platinum, palladium, germanium, ruthenium, rhodium, osmium, and iridium.

Such catalysts have been found to provide satisfactory benzene saturation at conditions including temperatures as low as 38° C. (100° F.), pressures from about 1400 to about 4800 kPa(g) (200 to 700 psig), an inlet hydrogen to hydrocarbon ratio in the range of about 0.1 to about 2, and about a 1 to 40 liquid hourly space velocity (LHSV). Other suitable pressures include from about 2068 to about 4137 kpa(g) (300 to 600 psig) and from about 2413 to about 3792 kPa(g) (350 to 550 psig) and other suitable liquid hourly space velocities include from about 4 to about 20 and 8 to 20 $hr^{-1}$. In another embodiment of this invention, the feed entering the hydrogenation zone will be heated to a temperature in the range of 38 to 232° C. (100 to 450° F.), 127 to 232° C. (260 to 450° F.) or 149 to 204° C. (300 to 400° F.) by heat exchange with the effluent from the hydrogenation and isomerization zones. The exothermic saturation reaction increases the heat of the combined feed and saturates essentially all of the benzene contained therein. The effluent from the hydrogenation zone provides a saturated feed for the isomerization zone that will typically contain from 0.01 wt.-% to 5 wt.-% or from 0.1 wt.-% to 1.5 wt.-% benzene or from 0.1 to 1.0 wt.-% benzene.

With the hydrogenation reaction being exothermic, the saturated feed from the hydrogenation reactor is typically at a temperature in the range of about 149 to about 288° C. (200 to 550° F.); about 177 to about 274° C. (350 to 525° F.); or about 204 to about 274° C. (400 to 525° F.). So the heat of the hydrogenation zone effluent may be recovered and used to provide heat to other colder streams either within the process or from outside the process. For example, the hydrogenation zone effluent may be heat exchanged with the combined feed.

Effluent from the hydrogenation zone enters a separator to separate hydrogen into a separator overhead stream. The hydrogen may be recycled or may be used elsewhere. The bottoms from the hydrogenation zone separator may be sent to a hydrogenation zone stabilizer to remove any remaining hydrogen other gases, or any C4− compounds into a hydrogenation zone stabilizer overhead and the cyclohexane hydrogenation product of the benzene saturation along with other C5 to C6 compounds into a hydrogenation zone stabilizer bottoms stream.

Turning to the FIGURE, The effluent from the reforming zone 8 which contains reforming reactor 6 is conducted in line 10 to a combined stabilizer naphtha splitter 12. Combined stabilizer naphtha splitter 12 is operated at 38° C. to 121° C. (100 to 250° F.) and from 70 kpa(g) to 1379 kpa(g) (about 10 to about 200 psig) so that a stream comprising $C7^+$ hydrocarbons are removed as a combined stabilizer naphtha splitter bottom stream 14 and light ends containing gases and $C3^-$ components are removed in an combined stripper naphtha splitter overhead stream 16. A heart cut stream 18 is removed from combined stabilizer naphtha splitter 12 and introduced into side stripper 20. Heart cut stream 18 comprises at least 25 wt. % benzene with the balance of components being primarily C5 and C6 compounds. Side stripper 20 is operated at conditions from about 172 kPa(g) to about 1724 kPa(g) (about 25 to about 250 psig) and 107° C. to 177° C. (225 to 350° F.) so that the side stripper bottom stream 22 is enriched in benzene and the side stripper overhead stream 24 is reduced in benzene. Overhead side stripper stream 24 is recycled to combined stabilizer naphtha splitter 12. Product stream 26 is removed as a side cut from stabilizer naphtha splitter 12. Side stripper bottom stream 22 is conducted along with hydrogen stream 30 to mixing device 32. Additionally, recycle optional stream 34 may be introduced to mixing device 32. The effluent of mixing device 32 in line 36 is conducted to a hydrogenation reactor 38 containing a catalyst 40 suitable for catalyzing hydrogenation and specifically the saturation of benzene. Hydrogenation reactor effluent 42 is reduced in benzene and enriched in cyclohexane. Hydrogenation reactor effluent 42 is conducted to hydrogenation zone separator 44. In hydrogenation zone separator 44, hydrogen is allowed to phase separate and is removed in separator overhead 46 while C5, C6, and C7+ compounds separate into separator bottoms 48. A portion of separator overhead 46 may be recycled to mixing device 32. At least a portion of the hydrocarbon material in line 48 is recycled via line 34 to the benzene saturation reactor 38. The recycle helps to control the exotherm that develops across the hydrogenation reactor. The remainder of the bottoms of the separator in line 48 is introduced into a hydrogenation zone stabilizer 50. Within the hydrogenation zone stabilizer 50, light ends are separated and removed in line 52 and the stabilized benzene depleted stream is removed as stream 54 is from the bottom of hydrogenation zone stabilizer 50 and collected. To conserve heat and reduce operating costs, stream 48 may be heat exchanged with stream 54 prior to being introduced into hydrogenation zone stabilizer.

The following example is intended to further illustrate the invention. This embodiment and demonstration of the invention is not meant to limit the claims of this invention to the particular details of the example.

A process as shown in the FIGURE was simulated using Aspen Plus software and the resulting concentrations of components in each stream was noted and placed in the Table below. Simulation conditions included operating the combined stabilizer naphtha splitter column at 38° C. (100° F.) and 517 kpa(g) (75 psig) and operating the side stripper at 146° C. (295° F.) and 724 kPa(g) (105 psig). The composition of the feedstock is shown in the TABLE as stream 10.

TABLE

| Name of | STREAM NUMBER wt. % component in stream | | | | | | | | | | | | |
|---|---|---|---|---|---|---|---|---|---|---|---|---|---|
| Component | 10 | 14 | 16 | 18 | 26 | 22 | 34 | 36 | 42 | 46 | 48 | 52 | 54 |
| Hydrogen | 0.00 | 0.00 | 0.01 | 0.00 | 0.00 | 0.00 | 0.04 | 1.56 | 0.42 | 23.18 | 0.04 | 1.18 | 0.00 |
| Light Ends (C4– and other gases) | 4.67 | 0.00 | 92.3 | 1.24 | 1.61 | 0.00 | 2.70 | 3.55 | 3.55 | 54.08 | 2.70 | 88.6 | 0.01 |
| C5 | 6.69 | 0.00 | 7.69 | 4.69 | 41.81 | 0.00 | 0.05 | 0.05 | 0.05 | 0.05 | 0.05 | 0.83 | 0.03 |
| C6*(minus benzene) | 9.15 | 0.07 | 0.01 | 54.4 | 55.3 | 18.7 | 63.2 | 47.2 | 62.4 | 16.2 | 63.2 | 8.21 | 64.9 |
| Benzene | 4.39 | 0.64 | 0.00 | 28.0 | 1.31 | 45.1 | 0.00 | 14.1 | 0.00 | 0.00 | 0.00 | 0.00 | 0.00 |
| C7+ | 70.3 | 96.2 | 0.00 | 1.34 | 0.00 | 5.17 | 2.65 | 3.35 | 2.61 | 0.34 | 2.65 | 0.02 | 2.73 |

The simulation data demonstrates that the combined stabilizer naphtha splitter can be operated to provide a product stream 26 that is reduced in benzene concentration as compared to the reforming effluent in line 10. Furthermore, the simulated data demonstrates that a heart cut stream 18 contains a quantity of benzene that is removed from the combined stabilizer naphtha splitter and concentrated using the side stripper into bottoms stream 22. The benzene in side stripper bottoms stream 22 is hydrogenated as shown by the benzene concentration of stream 42 and 54 being less than that of stream 22, and the C6 (minus benzene) concentrations of streams.

The invention claimed is:

1. A system for separating and saturating benzene from a reforming reactor effluent comprising:

a. a combined stabilizer and naphtha splitter;
b. a side stripper;
c. a hydrogenation reactor;
d. a reformate conduit in fluid communication with the combined stabilizer and naphtha splitter;
e. an overhead conduit in fluid communication with the combined stabilizer and naphtha splitter;
f. a sidecut conduit in fluid communication with the combined stabilizer and naphtha splitter;
g. a bottoms conduit in fluid communication with the combined stabilizer and naphtha splitter;
h. a heart cut conduit in fluid communication with the combined stabilizer and naphtha splitter and with the side stripper;
i. a side stripper overhead conduit in fluid communication with the side stripper and with the combined stabilizer and naphtha splitter;
j. a side stripper bottoms conduit in fluid communication with the side stripper and with the hydrogenation reactor; and
k. a hydrogenation reactor effluent conduit in fluid communication with the hydrogenation reactor.

2. The system of claim 1 further comprising a heat exchanger incorporating the reformate conduit and the bottoms conduit.

3. The system of claim 1 further comprising a heat exchanger incorporating the side stripper bottoms conduit and the hydrogenation reactor effluent conduit.

4. The system of claim 1 further comprising a separator in fluid communication with the hydrogenation reactor effluent conduit, a separator overhead conduit in fluid communication with the separator; and a separator bottoms conduit in fluid communication with the separator and with a stabilizer; a stabilizer overhead conduit in fluid communication with the stabilizer; and a stabilizer bottoms conduit in fluid communication with the stabilizer.

5. The system of claim 4 further comprising a heat exchanger incorporating the separator bottoms conduit and the stabilizer bottoms conduit.

6. The system of claim 1 further comprising a hydrogen conduit in fluid communication with the side stripper bottoms conduit.

7. The system of claim 1 wherein the side stripper bottoms conduit further comprises a mixing device.

8. The system of claim 1 further comprising a recycle conduit in fluid communication with the separator bottoms conduit and the side stripper bottoms conduit.

9. The system of claim 1 wherein the side cut conduit is in fluid communication with the combined stabilizer and naphtha splitter at a location between the overhead conduit and the side stripper overhead conduit.

10. The system of claim 1 wherein the heart cut conduit is in fluid communication with the combined stabilizer and naphtha splitter at a location between the reformate conduit and the side stripper overhead conduit.

* * * * *